US006511333B1

(12) United States Patent
Lee et al.

(10) Patent No.: US 6,511,333 B1
(45) Date of Patent: Jan. 28, 2003

(54) SIGNAL CONNECTOR WITH A RESISTOR-FIXING DEVICE

(76) Inventors: Chun Te Lee, No. 98-1, Lane Chin She Beei., Twen Chu Taichung (TW); Hui Hung Lee, No. 258, Lechiun St., Taichung (TW)

( * ) Notice: Subject to any disclaimer, the term of this patent is extended or adjusted under 35 U.S.C. 154(b) by 0 days.

(21) Appl. No.: 09/968,862

(22) Filed: Oct. 3, 2001

(51) Int. Cl.[7] ..... H01R 13/44; H01R 9/05
(52) U.S. Cl. ..... 439/133; 439/578
(58) Field of Search ..... 439/133, 304, 439/578

(56) References Cited

U.S. PATENT DOCUMENTS 4,469,386 A * 9/1984 Ackerman ..... 439/133
4,795,356 A * 1/1989 Pauza ..... 439/225
5,055,060 A * 10/1991 Down et al. ..... 439/304
5,608,415 A * 3/1997 Sugawara ..... 343/731
6,234,818 B1 * 5/2001 Lee ..... 439/304
6,428,333 B1 * 6/2002 Rust ..... 439/140

* cited by examiner

*Primary Examiner*—Brian Sircus
*Assistant Examiner*—Chandrika Prasad
(74) *Attorney, Agent, or Firm*—Troxell Law Office PLLC

(57) ABSTRACT

A signal connector includes a cylindrical signal connector body, and a resistor-fixing device positioned in the signal connector body. The resistor-fixing device consists of a metal tubular body and a stop. The metal tubular body has a first cone-shaped hole in a left vertical wall, and the stop fitting in a right opening of the metal tubular body has a second cone-shaped hole formed in a center portion, then a resistor formed with two round heads at two sides and two leads respectively extending outward from the two round heads. The two lead is held in two round holes in straight condition so as to closely contact with another connector.

6 Claims, 3 Drawing Sheets

SIGNAL CONNECTOR WITH A RESISTOR-FIXING DEVICE

BACKGROUND OF THE INVENTION

This invention relates to a signal connector, particularly to one provided with a resistor-fixing device for fixing stably a resistor in the signal connector.

As wire TV has been developing nowadays, pictures on the screen and quality of sounds of TV depends on signals transmitted to TV. Known conventional transmitting system of wire TV makes use of a signal distributor to transmit TV signal to every home, and the signal distributor generally has four sockets to connect to four homes. In case that any one of the four sockets is not used, it still transmits TV signals and part of signals may be fed back to interfere its own channels. Or exterior signals may intrude in the distributor to cause unclear pictures on the screen. Therefore, most of wire TV industries may use a special signal connector containing a resistor to screw with the socket unused for cutting off signals to protect quality of wire TV signals.

As to the resistor-fixing device for conventional signal connectors, as shown in FIG. 1, it includes a metal base 2 with a hollow chamber 3 for placing a resistor 1 therein. The metal base 2 has one end formed with an opening 4 and the other end formed with a bottom plate 5 bored with a hole 6 for one lead 7 of the resistor 1 to pass through and welded firmly around the hole 6 with a welded point 8. The other lead 9 of the resistor 1 is not fixed, located in the opening 4 in a suspended condition, so the other lead 9 cannot be held vertical and swaying around, resulting in loose contact with another connector to cause loss of signals. Further, the swaying lead may increase inconvenience in connecting other connectors.

SUMMARY OF THE INVENTION

The main objective of the invention is to offer a signal connector with a resistor fixing device, which includes a metal base provided with a first cone-shaped hole in the center, and a stop provided with a second con-shaped hole, letting two round heads of a resistor to fit respectively in the first and the second cone-shaped hole to stabilize the resistor without possibility of swaying around.

The next objective of the invention is to offer a signal connector with a resistor fixing device, holding two leads of the resistor in round holes in straight condition, permitting another connector contact closely so as to ensure no loss of signal transmitting.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
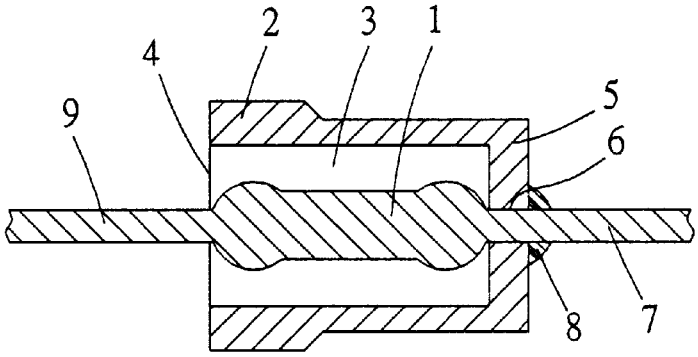
FIG.1 PRIOR ART
FIG. 1 is a perspective view of a known conventional resistor-fixing device for a signal connector.
Figure 2:
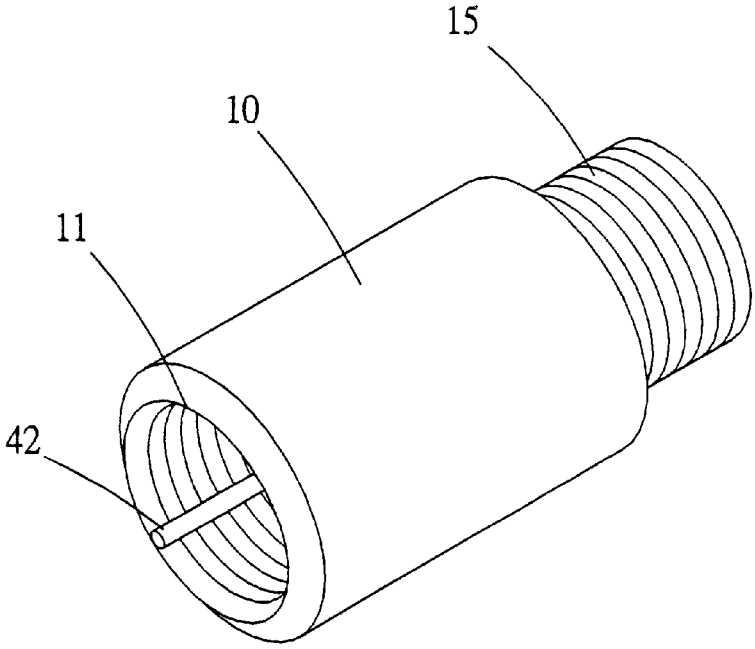
FIG. 2 is a perspective view of a signal connector in the present invention.
Figure 3:
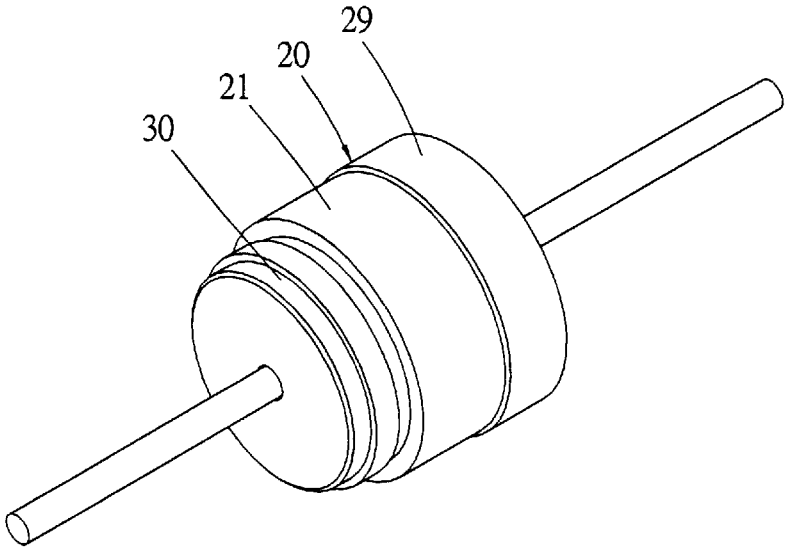
FIG. 3 is a perspective view of a resistor-fixing device for a signal connector in the present invention.
Figure 4:
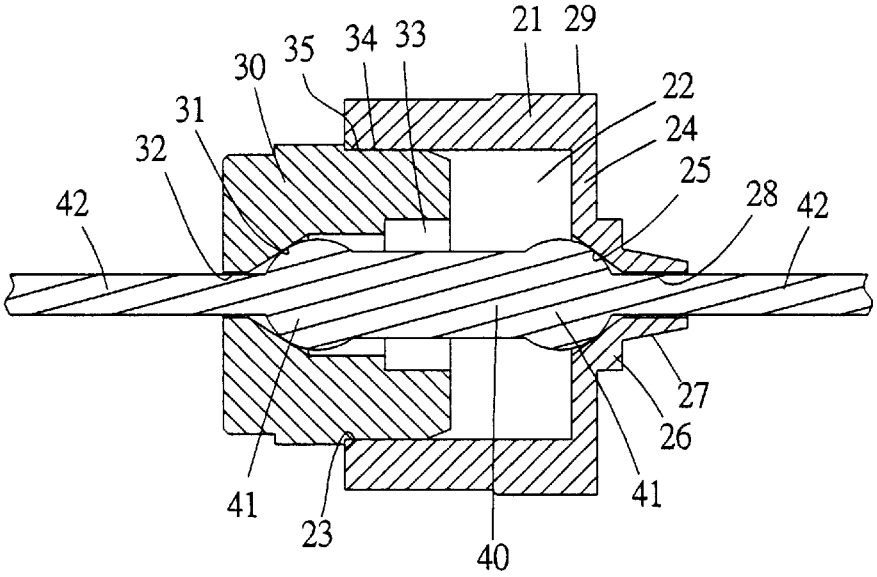
FIG. 4 is a cross-sectional view of the resistor fixing device for a signal connector in the present invention; and, FIG. 5 is a cross-sectional view of the signal connector with the resistor-fixing device in the present invention.

A preferred embodiment of a signal connector in the present invention, as shown in FIGS. 2, 3 and 4, includes a cylindrical signal connector body 10, and a resistor-fixing device 20 installed in the signal connector body 10.

The signal connector body 10 is made of metal, having an opening 11 formed in an inner end for inserting other components in its interior, and an outer end portion 15 of a smaller diameter than that of the opening 11 extending from an outer end of the cylindrical portion with a small hole 14 to communicating with the outer end portion 15. A threaded connect base 16 made of a metal tube is contained in the signal connector 10, having female threads 17 formed in an inner wall of an outer end portion to screw with a socket of a signal distributor, and a separating plate 18 is provided behind the female threads 17, having a center hole 19.

The resistor fixing device 20 is shown in FIG. 3, consisting of a metal base 21 and a stop 30, a hollow chamber 22 formed in the metal base 21, one end of the hollow chamber 22 having an opening 23 and the other end of the hollow chamber 22 closed with a sidewall 24. The sidewall 24 has a first cone-shaped hole 25 in the center, an annular projecting wall 26 formed to cover an outer annular side of the first cone-shaped hole 25 and a cone-shaped extension 27 with a smaller diameter hole 28 than the cone-shaped hole 25. Further, the metal base 21 has an annular projecting-outward surface 29 to connect with an inner wall of a threaded connect base 16.

The stop 30 is made of plastic, shaped as a round column, and having a second cone-shaped hole 31 in the center portion, a second round hole 32 formed in an inner end center, a third round hole 33 of a larger diameter than the second cone-shaped hole 31 formed to extend rightward from the second cone-shaped hole 31. Then the stop 30 is inserted half in the hollow chamber 22 of the metal base 21, having an annular outer surface 34 tightly contacting the inner wall of the hollow chamber 22, and a stop edge 35 formed behind the annular outer surface 34 to be stopped by an inner end of the metal base 21.

Next, a resistor 40 is provided with two round heads 41 formed at two ends and two leads 42 respectively extending from each round head 41 outward.

In assembling the signal connector in the invention, as shown in FIG. 4, firstly, the resistor 40 has its left lead 42 inserted in the hollow chamber 22 of the metal base 21 and passing through the first cone-shaped hole 25 and the first round hole 28. Then the right head 41 of the resistor 40 is made to fit in the first cone-shaped hole 25. Then the stop 30 has the third round hole 33 aligned to the left lead 42 of the resistor 40 to let the left lead 42 pass through the second cone-shaped hole 31 and the second round hole 32 until the left lead 42 reach the second cone-shaped hole 31.

Figure 5:
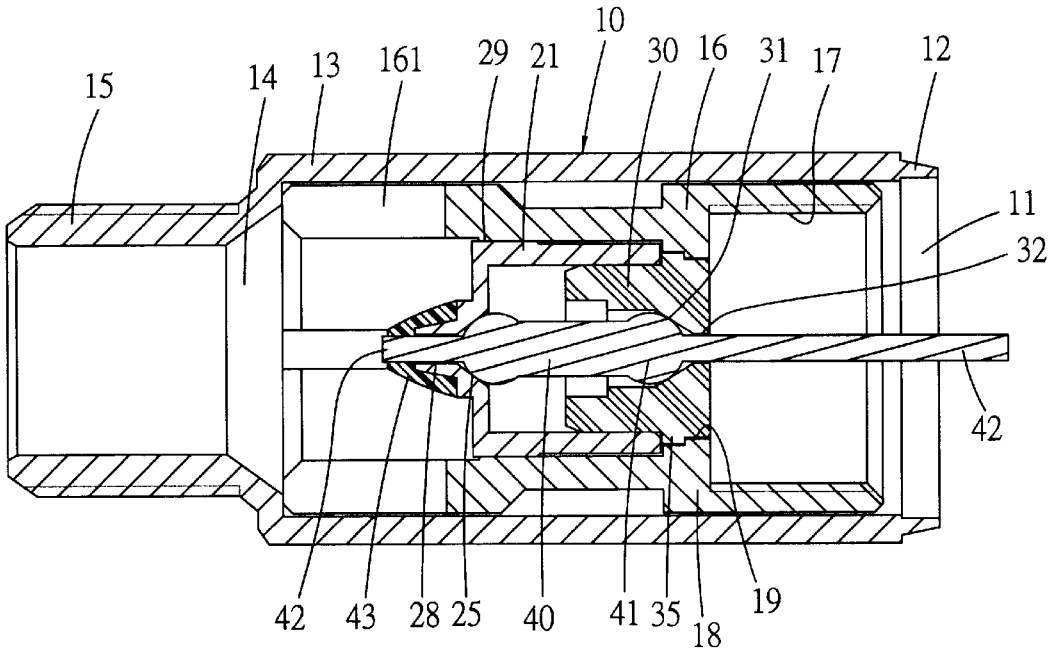

Next, as shown in FIG. 5, cut off the lead 42 protruding out of the cone-shaped projection 27, let it only expose its end of a preset length and then welded firmly with the cone-shaped projection 27 with a welding point 43.

Further, insert the resistor fixing device 20 in the threaded connect base 16, with the stop edge 35 of the stop 30 stopped by the separating plate 18, with the projecting-outward surface 29 tightly contacting the inner wall of the threaded connect base 16. Then the assembled resistor-fixing device 20 is inserted in the signal connector 10 in the correct position, and the annular end edge 12 of the opening 11 is closed up by means of riveting, finishing assembling of the signal connector in the invention.

The signal connector 10 in the invention is an example of a anti-illegal-connect signal connector, and the threaded hole 17 of the threaded connect base 16 is for screwing a socket of a distributor only with a special tool to insert through the opening 14 to engage an engage groove 161 of the threaded connect base 16 for screwing the threaded connect base 16 with a socket of a signal distributor.

It is noteworthy that the metal base 21 has the first cone-shaped hole 25 and the stop 30 has a second cone-shaped hole 31 for two round heads 41 to respectively fit therein to prevent the resistor 40 from swaying around so as to be positioned immovable.

In addition, it is worthy to say that the two leads 42 of the resistor 40 are respectively held in the first round hole 28 and the second round hole 32, keeping the two leads 42 in a straight condition, capable to contact with other connector, without loss of signal transmitted.

One more point to note is that one leads 42 is welded together with the cone-shaped projections 27 of the annular projecting wall 26, functioning well in conducting electricity, and also stabilizing the resistor 40 as well.

While the preferred embodiment of the invention has been described above, it will be recognized and understood that various modifications may be made therein and the appended claims are intended to cover all such modifications that may fall within the spirit and scope of the invention.

We claim:

1. A signal connector comprising a resistor fixing device in its interior;

said resistor-fixing device consisting of a metal base and a stop;

said metal base having a hollow chamber formed in its interior, one end of said hollow chamber having an opening, an other end of said hollow chamber having a sidewall bored with a first cone-shaped hole, and a smaller diameter hole than that of said first cone-shaped hole extending outward from said first cone-shaped hole;

said stop having a second cone-shaped hole formed in a center inner portion, and a second round hole of a smaller diameter than that of the second cone-shaped hole extending outward from said second cone-shaped hole;

a resistor having two round heads formed in two ends and two leads respectively extending out of said two round heads;

said two rounds heads of said resistor respectively fitting in the first cone-shaped hole of said metal base and the second cone-shaped hole of said stop, said two leads of said resistors respectively held straight in said first round hole and said second round hole.

2. The signal connector as claimed in claim 1, wherein said sidewall plate of said metal base has a hole, an annular projecting wall defining the hole, and a cone-shaped projection extending outward from said annular projecting wall.

3. The signal connector as claimed in claim 1, wherein said stop is made of plastic, having a third round hole of a larger diameter than that of the second cone-shaped hole, and said second cone-shaped hole is located inside said third round hole.

4. The signal connector as claimed in claim 1, wherein said resistor is placed in a threaded connect base, and then the threaded connect base is inserted and placed in said signal connector.

5. The signal connector as claimed in claim 1, wherein said stop has a stop edge formed on an outer surface.

6. The signal connector as claimed in claim 1, wherein said metal base has an annular projecting wall on an outer surface to contact and connect firmly with an inner wall of said threaded connect base.

* * * * *